US007765928B2

(12) United States Patent
Bieber et al.

(10) Patent No.: US 7,765,928 B2
(45) Date of Patent: Aug. 3, 2010

(54) PRINTING PLATE MATERIAL SPOOL AND METHOD OF LOADING THE SPOOL

(75) Inventors: Avigdor Bieber, Ra'anana (IL); Michael Driker, Maalot (IL)

(73) Assignee: Vim Technologies Ltd., Kibbutz Hanita (IL)

( * ) Notice: Subject to any disclaimer, the term of this patent is extended or adjusted under 35 U.S.C. 154(b) by 1097 days.

(21) Appl. No.: 11/214,920

(22) Filed: Aug. 31, 2005

(65) Prior Publication Data

US 2006/0048656 A1 Mar. 9, 2006

Related U.S. Application Data

(60) Provisional application No. 60/606,126, filed on Sep. 1, 2004.

(51) Int. Cl.
*B41F 27/12* (2006.01)

(52) U.S. Cl. ..... 101/480; 101/415.1; 242/587.3; 242/609.1; 242/125.1

(58) Field of Classification Search ..... 101/415.1, 101/477, 141, 480; 242/118.3, 587, 587.2, 242/532.6, 587.3, 609, 609.1, 118.31, 125.1
See application file for complete search history.

(56) References Cited

U.S. PATENT DOCUMENTS

| | | | | | |
|---|---|---|---|---|---|
| 4,826,096 | A | * | 5/1989 | Bailey et al. | 242/532.6 |
| 4,955,555 | A | * | 9/1990 | Pierson et al. | 242/348.4 |
| 4,967,976 | A | * | 11/1990 | Kawai et al. | 242/586.2 |
| 5,374,007 | A | * | 12/1994 | Murison | 242/538.2 |
| D372,118 | S | | 7/1996 | Moss et al. | |
| 5,657,692 | A | * | 8/1997 | Theriault et al. | 101/141 |
| 5,727,749 | A | | 3/1998 | Pensavecchia et al. | |
| 6,068,210 | A | * | 5/2000 | Risa | 242/532.5 |

* cited by examiner

*Primary Examiner*—Leslie J Evanisko
(74) *Attorney, Agent, or Firm*—Pearl Cohen Zedek Latzer, LLP

(57) ABSTRACT

Printing plate material supply spool (PMSS) for a printing machine or plate-imaging machine and a method of loading it is provided. An exemplary PMSS can comprise a printing plate material film that is wrapped around a hollow core (HC), wherein the HC is adapted to be engaged with a heavy duty core (HDC) prior to be placed in the printing machine. The method for loading the printing plate material supply spool (PMSS) in a printing machine or plate imaging machine may comprise inserting a heavy-duty core (HDC) inside the HC of the PMSS forming an integrated core. Then the PMSS and the integrated core can be placed in the printing machine.

19 Claims, 6 Drawing Sheets

PRINTING PLATE MATERIAL SPOOL AND METHOD OF LOADING THE SPOOL

CROSS-REFERENCE TO RELATED APPLICATIONS

This patent application claims the benefit of U.S. Provisional Application No. 60/606,126, filed on Sep. 1, 2004, the entire content of which is incorporated herein by reference.

BACKGROUND

1. Field of Invention

The present invention relates to digital printing apparatus and methods, and more particularly to a method and an apparatus for holding and winding of a film of lithographic printing material for digital printing press or plate imager equipment.

2. Description of Background Art

A plate-material supply spool (PMSS) has a predetermined amount of plate material film wrapped as a roll around a core. The core of current plate-material supply spool is formed of a heavy-duty, dimensionally stable material, such as stainless steel.

During the operation of a printing press or a plate imager equipment the plate material is transferred from the supply spool to an uptake spool. After exposing the entire film of the plate material, the core of the empty supply spool and the full uptake spool are removed. The core of the empty supply spool is installed as a new empty uptake spool. The full uptake spool can be disposed. More information on the current PMSS and printing machine can be found in U.S. Pat. No. 5,727,749 and U.S. design Pat. 372,118, the entire contents of which are incorporated herein by reference.

Following are some limitations of the current supply spool. The plate material supply spool is quite expensive due to the cost of the heavy-duty core that is embedded within each one of the plate material supply spool. Furthermore, the plate material supply spool is quite heavy due to the weight of its core, which increases the transportation cost. Last but not the least, handling and/or recycling the used plate material spool having the heavy-duty core is complicated.

Therefore, it is evident that there is a need for an apparatus and a method for assembling the spool of plate material. The new method and apparatus will reduce the cost of a plate material supply spool (PMSS), reduce the cost of transportation and the cost of recycling and or disposing of the used full uptake spool including plate material.

SUMMARY OF THE INVENTION

An exemplary embodiment of the present invention uses a PMSS having a core, which is a hollow core (HC). The hollow core may be made of plastic such as but not limited to: Nylon, Acetal copolymer, Delrin, Polycarbonate, Polystyrene, Polyvinylchloride, Polysulfone, Polyester, Phenolic, Polyphenylene, or may be made of carton or light metal such as but not limited to Aluminum, for example. Exemplary criteria for defining the material from which the HC is fabricated may be based on recycling considerations. In case that the printed plate material film is made of Polyester, the HC may be made also from Polyester. The hollow core is used as a core on which the film of the plate material is wrapped around by the plate material vendor in order to produce the PMSS.

In a printing machine, two heavy-duty cores (HDC) are used for each plate cylinder. For example, in four color press, which has four plate cylinders, eight HDCs can be used. One HDC is inserted inside the HC of a new PMSS. The other HDC is inserted inside an empty HC, which was associated with a previous PMSS. Inserting a HDC inside a HC forming an integrated core. Both cores, the HC and the HDC, have a coupling mechanism. The coupling mechanism engages the two cores (the HC and the HDC), forcing them to rotate together. Two HDCs and one HC can be sold once per printing machine. In addition, an inexpensive HC is supplied as part of a new PMSS. In this application the terms "press", "press machine", "printing machine", "digital printing press" and "plate imager equipment" are used interchangeably.

In one exemplary embodiment of the present invention, the HDC may be assembled from two parts, a first part and a second part. The first part is inserted inside the HC from one side of the HC. The second part of the HDC is inserted into the HC from the other side of the HC. The two parts of the HDC are engaged together inside the HC.

In an alternate exemplary embodiment of the present invention the HDC may be a single cylinder that is inserted inside the HC through one of the sides of the HC.

An exemplary embodiment of the present invention may use two symmetrical longitudinal slots in the HC and a penetrating longitudinal slot in the HDC. When the HC and the HDC are engaged, the two symmetrical longitudinal slots of the HC and the penetrating longitudinal slot in the HDC are merged into one merged penetrating longitudinal slot. When the couple of an empty HC and its associated HDC are used as an uptake spool, the merged penetrating longitudinal slot is used for transferring a leading edge (a tab) of a film of a new plate material spool from one side of the uptake spool to the other side.

While loading a new PMSS in a printing press, the leading edge (the tab) of the new film can be inserted easily and straightly through the merged penetrating longitudinal slot of the uptake spool. The tab can be transferred from one side of the uptake spool to the other side to be covered and be held by following windings of the new film. In alternate embodiment other mechanism may be used in order to hold the film of the plate material. For example, pins may be used instead of the slot. The pins may be part of the HDC that pass via appropriate slots in the HC.

Other objects, features, and advantages of the present invention will become apparent upon reading the following detailed description of the exemplary embodiments of the present invention with the accompanying drawings and appended claims.

DETAILED DESCRIPTION OF EXEMPLARY EMBODIMENTS

Turning now to the figures in which like numerals represent like elements throughout the several views, exemplary embodiments of the present invention are described. For convenience, only some elements of the same group may be labeled with numerals. The purpose of the drawings is to describe exemplary embodiments and not for production. Therefore dimensions of components and features shown in the figures are chosen for convenience and clarity of presentation and are not necessarily shown to scale.

Figure 1:
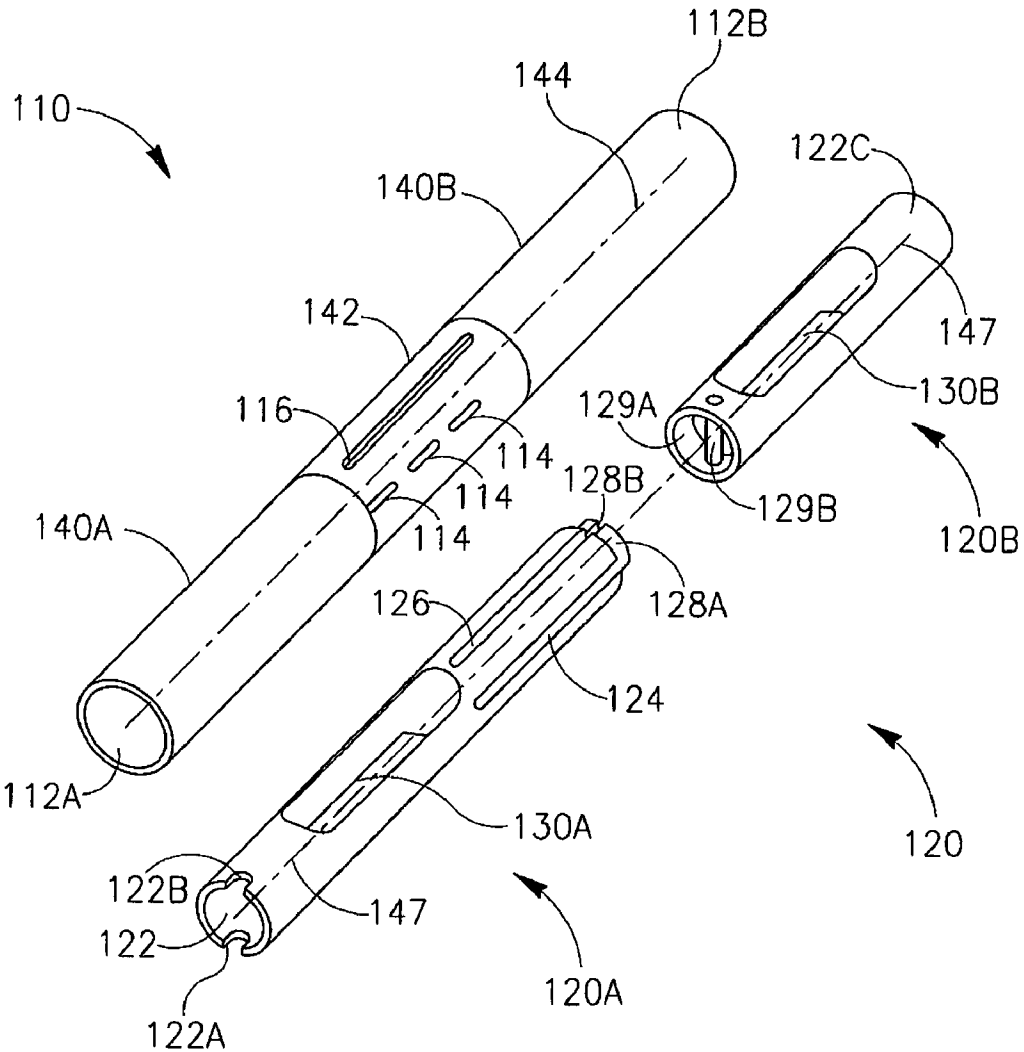
FIG. 1 illustrates an isometric view with relevant elements of an exemplary couple, a hollow core and a heavy-duty core having two parts, according to an exemplary embodiment of the present invention.

Reference is now made to FIG. 1, which is an isometric view illustrating relevant elements of an exemplary couple, a hollow core (HC) 110 and a heavy-duty core (HDC) 120 having two parts 120A and 120B. HC 110 may be made of plastic such as but not limited to: Nylon, Acetal copolymer, Delrin, Polycarbonate, Polystyrene, Polyvinylchloride, Polysulfone, Polyester, Phenolic, Polyphenylene or may be made of carton or light metal such as but not limited to Aluminum, for example. The material, from which an exemplary HC 110 is made, may enable using the same disposal process for the used printing plate material and its associated HC.

HC 110 may be in a length of L1 (FIG. 2) and have a central axis 144. The length, L1, of HC 110 sufficiently fits the requirements of the printing machine and the requirement of the size of the printing plate. HC 110 may have symmetrical longitudinal slots 116 one in each side of the central axis 144. The slot 116 on the other side of the central axis 144 is not shown in the figures. The symmetrical longitudinal slots 116 are used for transferring a tab, which are located at the free end (leading edge) of a plate material film, from one side of the HC 110 to the other side.

The external surface of the HC 110 may have two levels a high-level area 140A and 140B and a low-level area 142 in the center. The length of the low-level area 142 may fit the size of the tab. The tab may have a shape such as trapezoidal shape. The difference between the height of the two levels, 140 and 142 may fit the thickness of the plate material film. The surface of the HC 110 may be rough.

The internal surface of the HC 110 may have one or more than one pins 114. The pins 114 may be organized in a line that is parallel to the axis 144 of the HC 110 and are protruding toward the axis 144. The pins 114 are used as one section of a coupling mechanism between the HC 110 and the HDC 120. The other section of the coupling mechanism is located in the HDC 120 as it is disclosed below. Other exemplary embodiment of the present invention may use a shaft key, a keyway, etc. as a coupling mechanism instead of the one or more pins 114.

The HDC 120 may be made of Steel, Stainless Steel, Iron, Brass or similar material. The exemplary HDC 120 is heavier than a HC 110. In the example of FIG. 1 HDC 120 is constructed from two parts a left part (LP) 120A and a right part (RP) 120B. The left and the right sides, which are mentioned along the present discloser, are in reference to the drawing and not to a printing machine. The Left part (LP) 120A may comprise a printing machine interface section 122 having two niches 122A and 122B; a film tab longitudinal penetrating slot 126; a HDC coupling slot 124; and a LP coupling section 128A and 128B. The right part (RP) of HDC 120B may comprise a RP coupling section 129A and 129B; and a printing machine interface section 122C. HDC 120 may have a central axis 147. The length of HDC 120 sufficiently fits the requirements of the printing machine and the requirement of the size of the printing plate. The length of HDC 120 may be equal to the length L1. The length, radius, weight, strength and the interface sections 122 and 122C sufficiently fit the requirements of the printing machine.

In the example of FIG. 1 the left interface section 122 comprises two niches 122A and 122B that sufficiently fit a toothed coupling member. The right interface section 122C (is not shown in the drawing) sufficiently fits an engagement member. The toothed coupling member and the engagement member are used to hold the HDC with its associated HC inside the plate cylinder and to transfer the rotational momentum to the HDC. The exemplary couple of HC and HDC of FIG. 1 fits a QM-DI printing machine, manufactured by Heidelberg (QM-DI is a registered trademark of Heidelberg).

In an alternate exemplary embodiment of the present invention (which is not shown in the drawing) the left interface section may comprises a toothed coupling member. The right interface section may comprise an engagement member. In a printing machine, manufactured by the printing press manufacturer such as Heidelberg or RYOBI, the toothed coupling member and the engagement member are used to hold the HDC with its associated HC inside the plate cylinder and to transfer the rotational momentum to the HDC.

The HDC coupling slot 124 may be a longitudinal slot that sufficiently fits the size and the location of the one or more than one pins 114. The positioning of the printing machine interface section 122, slots 124 and 126, pins 114 and the symmetrical longitudinal slots 116 are set according to the requirement of the printing machine type and the plate martial film.

The exemplary LP coupling section may comprise a protrudent cylinder 128A having a smaller radius than the external radius of the LP 120A. Protrudent cylinder 128A may have a slot 128B. The slot 128B may be a continuation to slot 126. The RP 120B coupling section may include a hole 129A with a pin 129B that sufficiently fits the protrudent cylinder 128A and its slot 128B. HDC 120 may include one or more holes 130A and 130B. Holes 130A and 130B can be used for adjusting the weight of HDC 120.

Figure 2:
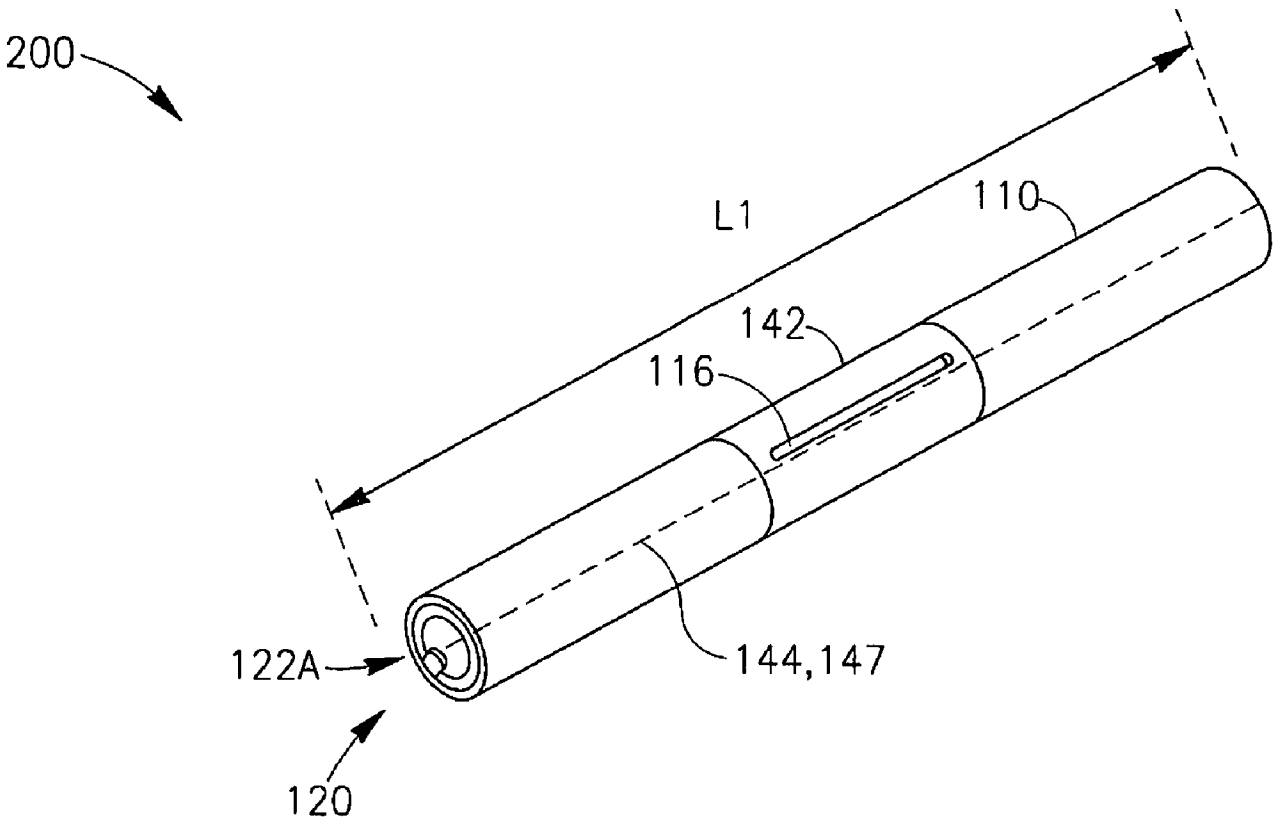
FIG. 2 illustrates an isometric view of the cores of FIG. 1 engaged together as an empty uptake spool.

FIG. 2 illustrates an isometric view of the two cores 110 and 120 of FIG. 1 engaged together; creating an integrated core 200 that can be used as an empty uptake spool. It can be seen that HDC 120 is inserted into HC 110 in such a way that both axis 144 and 147 overlap each other. The left interface section of HDC 120 with the two niches 122B and 122B are demonstrated. Also it can be seen that the internal radius of the HC 110 sufficiently fits the external radius of HDC 120. Inserting the HDC 120 inside the HC 110 is done in two stages. The LP 120A can be inserted first into left end 112A of HC 110. Positioning of the LP 120A in the HC 110 is done according to the coupling mechanism by slipping pins 114 inside slot 124 (FIG. 1) forcing the symmetrical longitudinal slots 116 to be above and below slot 126 creating one merged penetrating slot that sufficiently fits the tab at the free end of a new PMSS. Then, RP 120B can be inserted through the right end 112B of HC 110 (FIG. 1). Positioning the RP 120B in the HC 110 is done according to the coupling mechanism between LP 120A and RP 120B by slipping cylinder 128A in hole 129A while pin 129B is inserted into slot 128B (FIG. 1).

While loading the new PMSS in a printing press, the tab can be inserted easily through the merged penetrating longitudinal slot of the uptake spool. The tab can be transferred from one side of the uptake spool to the other side to be covered and be held by following windings of the new film.

During operation when a supply PMSS reaches the end of the plate material film. Both spools, the empty supply spool and the full uptake spool are removed from the plate cylinder of the printing machine. The empty supply spool, comprises the HC and the HDC, is placed as a new uptake spool. The HDC of the full uptake spool is removed. Removing the HDC may be done by pulling out both parts. The left part 120A is pulled to the left. The right part 120B is pulled to the right. Then the full uptake roll of the used plate material film with its HC 110 can be disposed.

The removed left part 120A and right part 120B of the HDC of the old uptake spool is inserted inside a new plate material supply spool that was wrapped over an HC 110 by the PMSS vendor. Inserting the two parts of HDC 120 in the new HC is done in the same method as it is disclosed above.

Figure 3:
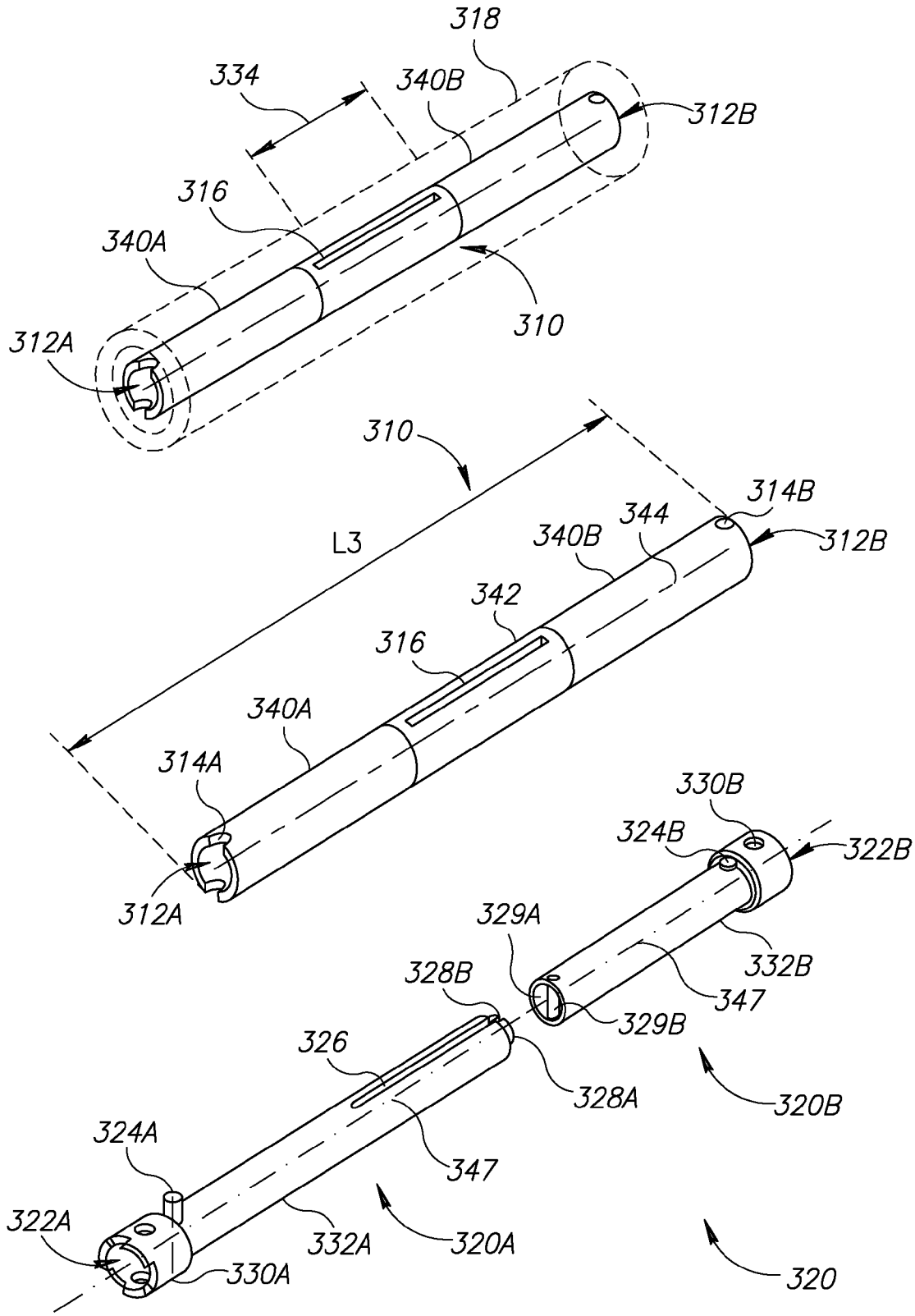
FIG. 3 illustrates an isometric view with relevant elements of another exemplary couple, a hollow core and a heavy-duty core having two parts, according to another exemplary embodiment of the present invention.

Referring now to FIG. 3, which is an isometric view illustrating relevant elements of another exemplary couple of cores, a hollow core (HC) 310 and a heavy-duty core (HDC) 320 having two parts 320A and 320B. HC 310 may be made of plastic such as but not limited to: Nylon, Acetal copolymer, Delrin, Polycarbonate, Polystyrene, Polyvinylchloride, Polysulfone, Polyester, Phenolic, Polyphenylene or light metal such as but not limited to Aluminum, for example or may be made of carton. The material, from which an exemplary HC 310 is made, may enable using the same disposal process for the used printing plate material and its associated HC.

HC 310 may be in a length of L3 and have a central axis 344. HC 310 may have symmetrical longitudinal slots 316, one in each side of the central axis 344. The slot 316 on the other side of the central axis 344 is not shown in the figures. When the couple of the cores 310 & 320 are used as an uptake spool, symmetrical longitudinal slots 316 are used for transferring a tab 334, which is located at the free end (leading edge) of a plate material film 318, from one side of the HC 310 to the other side.

The external surface of the HC 310 may have two levels: a high-level area 340A and 340B and a low-level area 342 in the center. The length of the low-level area 342 may fit the size of the tab. The difference between the height of the two levels, 340A and 340B and 342 may fit the thickness of plate material film 318. The surface of the HC 310 may be rough.

One or both sides 312*a* and/or 312*b* of the HC 310 may have a first section of a coupling mechanism to HDC 320 (niches 314A and 314B, for example). A second section of the coupling mechanism, pins 324A and 324B respectively, are located in the HDC 320 as it is disclosed below. The coupling mechanism 314A and 314B with pins 324A and 324B are used for keeping the HC 310 and the HDC 320 in the appropriate relative position and transferring the rotational momentum from the HDC 320 to the HC 310. Other exemplary embodiment may use other coupling mechanism including but not limited to a shaft key, a keyway, etc. The left section of the coupling mechanism, 314A and 324A, may differ from the right section, 314B and 324B, in order to emphasize the appropriate direction. For example, the left section may have two pines/niches, 314A and 324A, while the right section may have only one pin/niche, 314B and 324B, other embodiment may use pins/niches in different diameter or shape, etc.

HDC 320 may be made of Steel, Stainless Steel, Iron, Brass or similar material. The exemplary HDC 320 is heavier than a HC 310. In the example of FIG. 3, HDC 320 is constructed from two parts a left part (LP) 320A and a right part (RP) 320B. The Left part (LP) 320A may comprise a printing machine interface section 322A; a second section of HC coupling mechanism pins 324A; a film tab longitudinal penetrating slot 326; and a LP coupling section 328A and 328B. The right part (RP) of HDC 320B may comprise a RP coupling section 329A and 329B; a second section of HC coupling mechanism, pins 324*b*; and a printing machine interface section 322B.

The surface of the HDC 320 may have two levels. A high-level area 330A and 330B at the left and the right edges of HDC 320, respectively. The main area of HDC 320 is a low-level area 332A and 332B. The total length of the low-level area 332A and 332B of HDC 320 when both parts 330A and 330B are engaged is sufficiently equal to the length L3 of HC 310.

When both parts 320A and 320B are engaged, HDC 320 may be in a total length of L4 (FIG. 4) with a central axis 347. The length, L4, of HDC 320 sufficiently fits the requirements of the printing machine and the requirement of the size of the printing plate. The length, radius, weight, strength and the interface sections 322A and 322B fit the requirements of the printing machine. The radius of the low-level parts 332A and 332B sufficiently fits the internal radius of HC 310. The radius of the high-level part 330A and 330B sufficiently fits the external radius of HC 310.

The left interface section 322A comprises a toothed key that sufficiently fits a toothed coupling member that is part of the printing machine. The right interface section 322B sufficiently fits an engagement member. The toothed coupling member and the engagement member are used to hold the HDC 320 with its associated HC 310 inside a plate cylinder and to transfer the rotational momentum to the HDC 320. The exemplary couple of HDC 320 and HC 310 of FIG. 3 fit the requirements of a digital printing machine, manufactured by RYOBI.

In an alternate exemplary embodiment of the present invention (which is not shown in the drawing) the left interface section may comprises a toothed coupling member. The right interface section may comprise an engagement member. In a printing machine, manufactured by the printing press manufacturer such as Heidelberg or RYOBI, the toothed coupling member and the engagement member are used to hold the HDC with its associated HC inside the plate cylinder and to transfer the rotational momentum to the HDC. In such an exemplary embodiment, the length of the HDC may be longer than the length of the HDC 320 of the previous example.

The HC coupling pins 324A and 324B sufficiently fit the location of the one or more than one niches 314A and 314B. The position of the HC 310 in respect to the LP (left part) and RP (right part) of the HDC 320A and 320B may be identified by different external diameter of pins 324A and 324B and respectively the internal radius of 314A and 314B. The positioning of the printing machine interface section 322A and 322B, longitudinal penetrating slot 326, and symmetrical longitudinal slots 316 are set according to the requirement of the printing machine type and the plate martial film.

The exemplary LP coupling section 328A and 328B may comprise a protrudent cylinder 328A having a smaller radius than the external radius of the low-level area 332A. Protrudent cylinder 328A may have a slot 328B. The slot 328B may be a continuation of longitudinal penetrating slot 326. The RP 320B coupling section 329A and 329B may include a hole 329A, which sufficiently fit the protrudent cylinder 328A, and a pin 329B that sufficiently fits the slot 328B.

Figure 4:
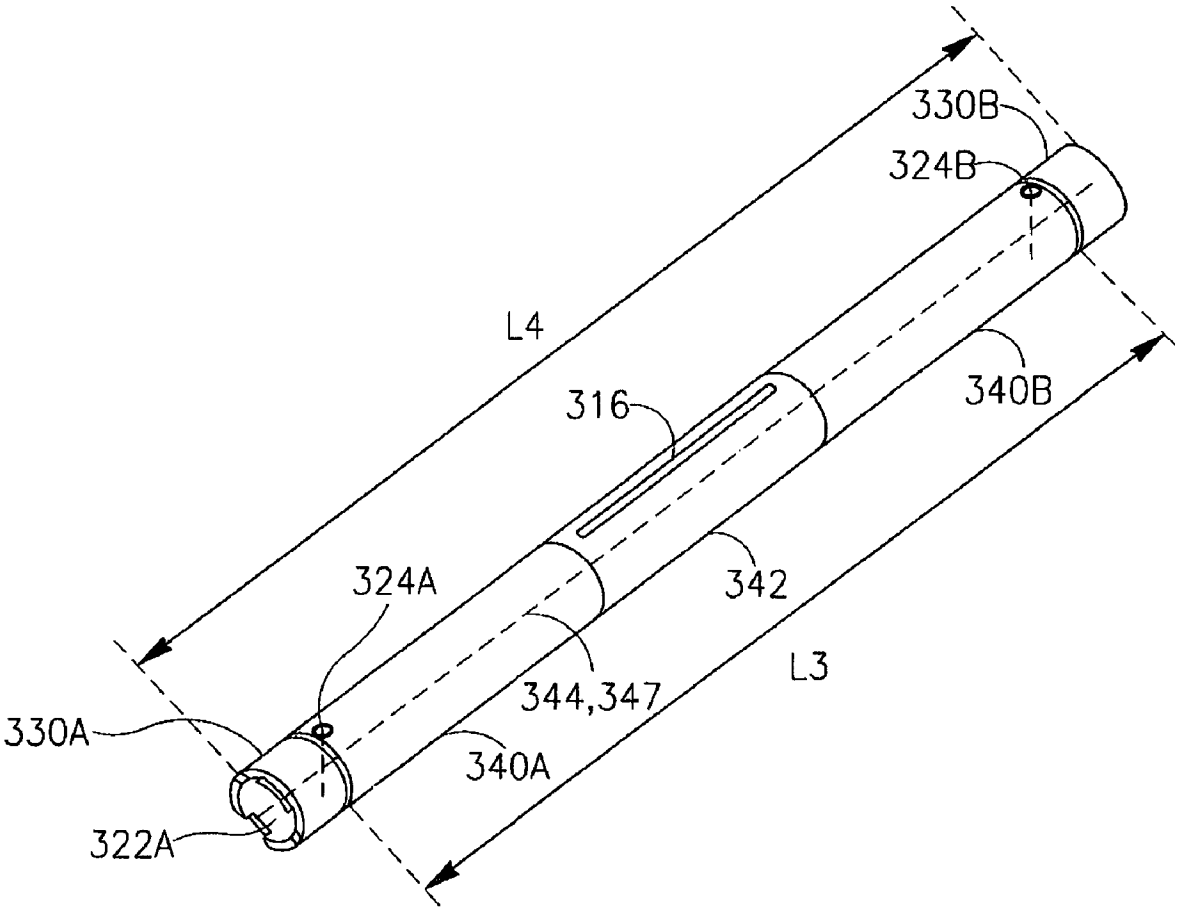
FIG. 4 illustrates an isometric view of the cores of FIG. 3 engaged together as an empty uptake spool.

FIG. 4 illustrates an isometric view of the two cores 310 and 320 of FIG. 3 engaged together as an integrated core. The integrated core can be used as an empty uptake spool. It can be seen that HDC 320 is inserted into HC 310 in such a way that both axis 344 and 347 overlap each other. The left interface section of HDC 320 with the toothed key 322A is demonstrated. Also it can be seen that the external radius of the high-level areas 340A and 340B of HC 310 sufficiently fits the level of pins 324A and 324B and the external radius of the high-level area 330A and 330B of HDC 320. In order to facilitate the insertion of the two parts of the HDC, 320A and 320B, into the HC 310 of a new PMSS, the external diameter of the high-level areas 330A and 330B may be slightly smaller than the external diameter of the HC 310.

Inserting the HDC 320 inside the HC 310 can be done in two stages. The LP 320A can be inserted first. Positioning of the LP 320A in the HC 310 is done according to the coupling mechanism by slipping pins 324A and 324B inside niches 314A and 314B (FIG. 3) respectively forcing the symmetrical longitudinal slots 316 to be above and below longitudinal penetrating slot 326 creating one merged longitudinal penetrating slot that sufficiently fits tab 334 at the free end of a new PMSS. Then, RP 320B is inserted through the right end 312B of HC 310 (FIG. 3). Positioning the RP 320B in the HC 310 is done according to the coupling mechanism between the HC 310 and the HDC 320 314A/324A and 314B/324B) as well as the coupling mechanism between the LP 320A and RP 320B as it is disclosed above.

While loading the new PMSS in a printing press, tab 334 can be inserted easily through the merged penetrating longitudinal slot of the uptake spool. Tab 334 can be transferred from one side of the uptake spool to the other side to be covered and be held by following windings of the new film.

During operation when a supply PMSS reaches the end of plate material film 318. Both spools, the empty supply spool and the full uptake spool are removed from the plate cylinder of the printing machine. The empty supply spool, comprises the HC and the HDC, is placed as a new uptake spool. The HDC of the full uptake spool is removed. Removing the HDC may be done by pulling out both parts. The left part 320A is pulled to the left. The right part 320B is pulled to the right. Then the full uptake roll with its HC 310 can be disposed.

The removed left part 320A and right part 320B of the HDC of the old uptake spool is inserted inside a new plate material supply spool that was wrapped over an HC 310 by the PMSS vendor. Inserting the two parts of HDC 320 in the new HC is done in the same method as it is disclosed above.

Figure 5:
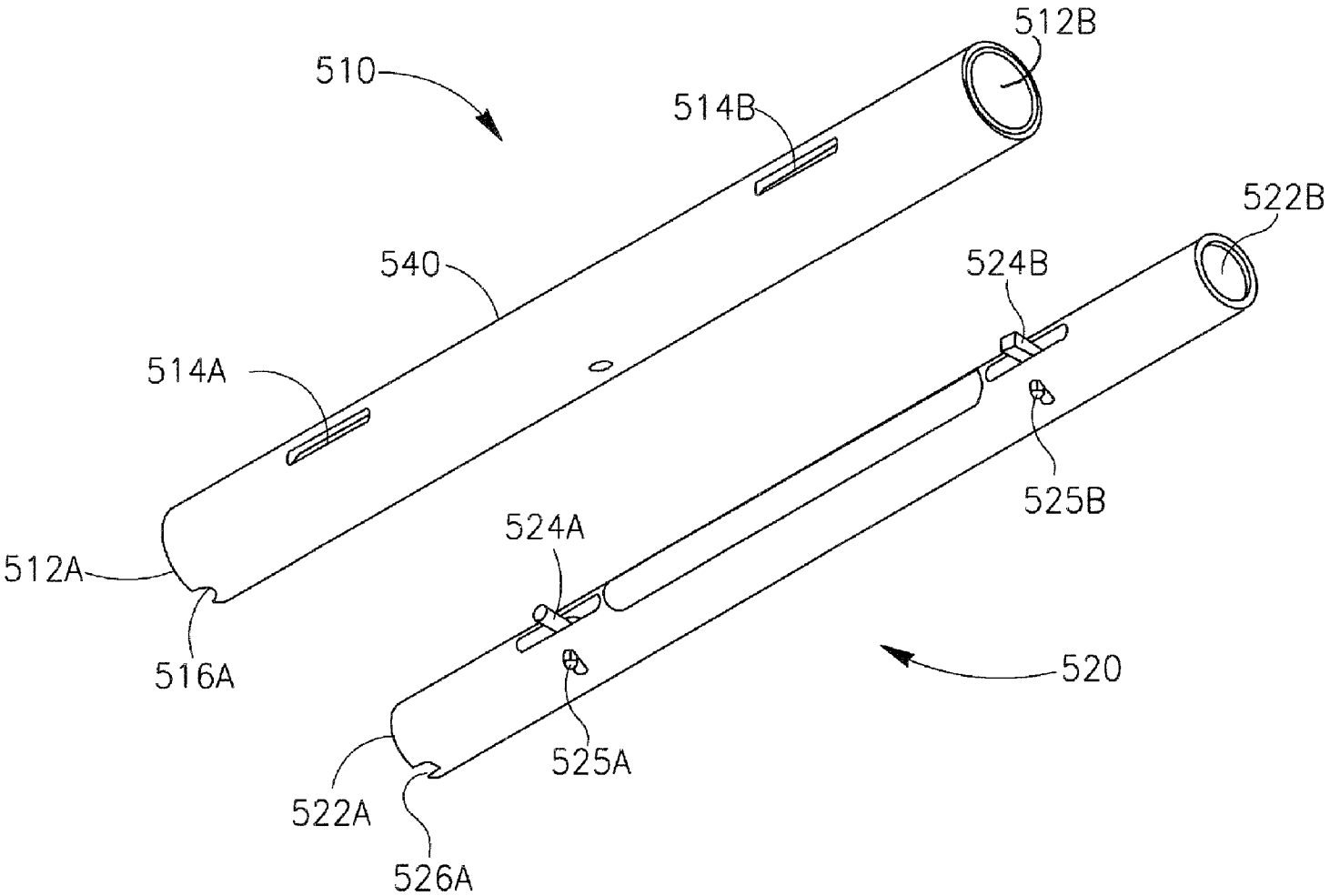
FIG. 5 illustrates an isometric view with relevant elements of an alternate exemplary couple, a hollow core and a heavy-duty core, according to an alternate exemplary embodiment of the present invention.

Referring now to FIG. 5, which is an isometric view illustrating relevant elements of another exemplary couple of cores, a hollow core (HC) 510 and a heavy-duty core (HDC) 520. HC 510 may be made of plastic such as but not limited to: Nylon, Acetal copolymer, Delrin, Polycarbonate, Polystyrene, Polyvinylchloride, Polysulfone, Polyester, Phenolic, Polyphenylene or may be made of carton or light metal such as but not limited to Aluminum, for example. The material, from which an exemplary HC 510 is made, may enable using the same disposal process for the used printing plate material and its associated HC. The length of HC 510 sufficiently fits the requirements of the printing machine and the requirement of the size of the printing plate.

Figure 6:
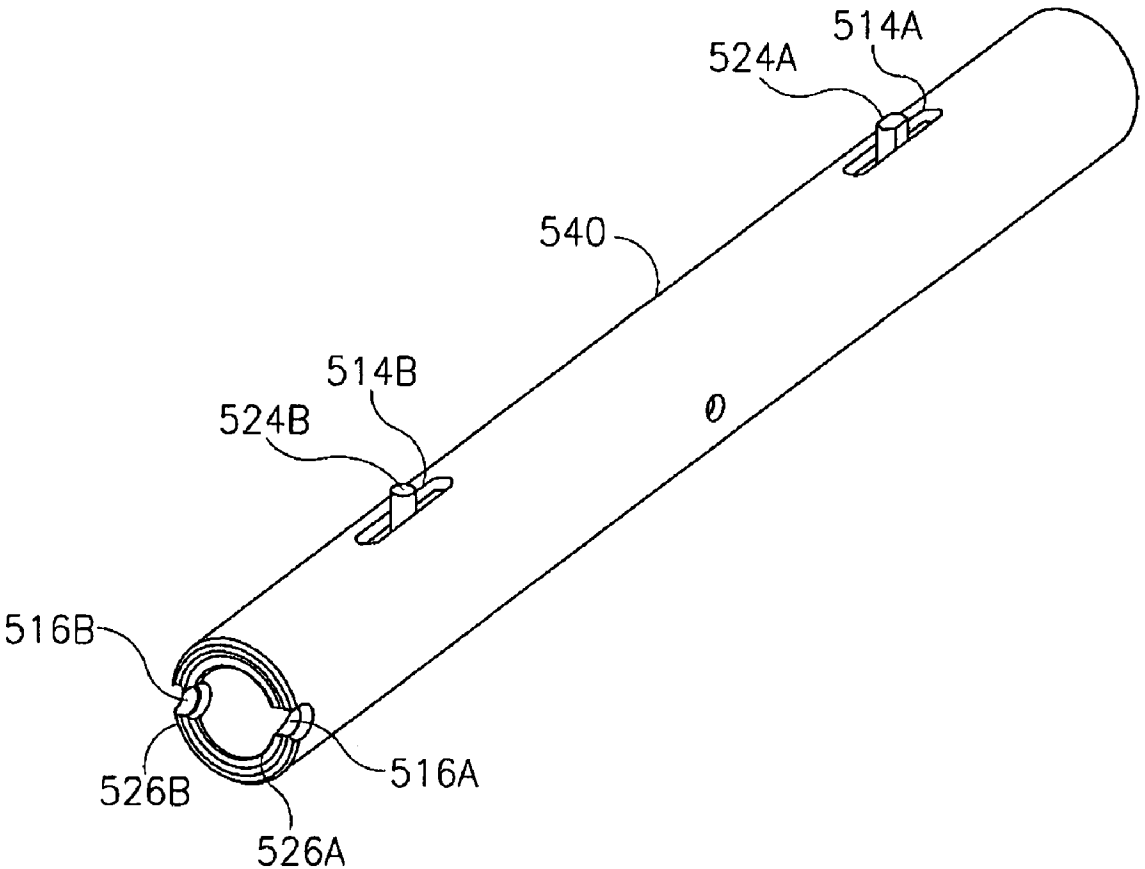
FIG. 6 illustrates an isometric view of the cores of FIG. 5 engaged together as an empty uptake spool.

HC 510 may have a body 540 and two facets, a left facet 512A and a right facet 512B. The body 540 may have two or more longitudinal slots 514A and 514B. When the couple of the cores 510 & 520 are engaged and used as an uptake spool, slots 514A and 514B are penetrated by pins 524A and 524B respectively. Slots 514A and 514B and pins 524A and 524B are used as a coupling mechanism between HC 510 and HDC 520. Furthermore, the portion of the pins 524A and 524B that passes through the slots 514A and 514B can be used for accepting two or more appropriate slots that may be punched at the free end of the plate material film. The Left facet 512A of HC 510 may comprise a printing machine interface section having two niches 516A and a symmetric one 516B (FIG. 6).

The HDC 520 may be made of Steel, Stainless Steel, Iron, Brass or similar material. HDC 520 may comprise a printing machine interface section 522A having two niches 526A and a symmetric one 526B (FIG. 6); a HC coupling pins 524A and 524B; and a printing machine interface section 522B. The length of HC 510 and HDC 520 sufficiently fits the requirements of the printing machine and the requirement of the printing plate. The length, radiuses, weight, strength and the interface sections 522A with 512A and 522B with 512B (when the HDC 520 is inserted in the HC 510) sufficiently fit the requirements of the printing machine.

When the HDC 520 is inserted in the HC 510 the left interface section 512A and 522A with the two niches on each core that sufficiently fit a toothed coupling member. The right interface section 512B and 522B sufficiently fits an engagement member. The toothed coupling member and the engagement member are used to hold the HDC 520 with its associated HC 510 inside the plate cylinder and to transfer the rotational momentum to the HC&HDC 510&520 respectively. The exemplary couple of HC and HDC of FIG. 5 can fit a QM-DI printing machine, manufactured by Heidelberg (QM-DI is a registered trademark of Heidelberg).

The two or more pins 524A and 524B may be assembled over a springy mechanism 525A and 525B, respectively. The springy mechanism 525A and 525B enables the movement up/down and left/right of pins 524A and 524B while assembling or pulling of HDC 520 into or out of HC 510 and to absorb the presence of the first (new or used) binding of the printed material film.

FIG. 6 illustrates an isometric view of the two cores 510 and 520 of FIG. 5 engaged together as an integrated core. The integrated core can be used as an empty uptake spool. It can be seen that HDC 520 is inserted into HC 510. The left interface section of HDC 520 with the two niches 526A and 526B and the left interface section of HC 510 with the two niches 516A and 516B are demonstrated. Forming the interface section that sufficiently fits the toothed coupling member of the printing machine. Inserting the HDC 520 inside the HC 510 is done by positioning the HDC 520 in the HC 510 is done according to the coupling mechanism by slipping pins 524A and 524B inside slots 514A and 514B (respectively) forcing slots 514A and 514B to be above pins 524A and 524B. The extended portion of pins 524A and 524B sufficiently fit punched slots at the free end of a new PMSS.

During operation when a supply PMSS reaches the end of the plate material film. The two spools, the empty supply spool and the full uptake spool are removed from the plate cylinder of the printing machine. The empty supply spool, comprises the HC 510 and the HDC 520, is placed as a new uptake spool. The HDC of the full uptake spool is removed. Removing the HDC may be done by pulling out the HDC from the HC forcing pins 524A and 524B down, into the HDC to allow the relative movement between the two cores.

The removed HDC 520 of the old uptake spool is inserted inside a new plate material supply spool that was wrapped over an HC 510 by the PMSS vendor. Inserting the HDC 520 in the new HC 510 is done in the same method as it is disclosed above Overall, this invention provides a low cost disposable core for a print material supply spool compare to the current art.

In the description and claims of the present application, each of the verbs, "comprise" "include" and "have", and conjugates thereof, are used to indicate that the object or objects of the verb are not necessarily a complete listing of members, components, elements, or parts of the subject or subjects of the verb.

The present invention has been described using detailed descriptions of embodiments thereof that are provided by way of example and are not intended to limit the scope of the invention. The described embodiments comprise different features, not all of which are required in all embodiments of the invention. Some embodiments of the present invention utilize only some of the features or possible combinations of the features. Variations of embodiments of the present invention that are described and embodiments of the present invention comprising different combinations of features noted in the described embodiments will occur to persons of the art. The scope of the invention is limited only by the following claims.

What is claimed is:

1. A printing plate material supply spool for a printing machine or plate-imaging machine, the supply spool comprising:

a first hollow elongated cylindrical core configured to be externally concentrically engaged with a second heavy-duty core made of heavy-duty dimensionally stable material, wherein the first hollow core is configured to be removable from the second heavy-duty core;

a printing plate material film wrapped around the first hollow core, wherein the first hollow core comprises a coupling mechanism configured to engage the first hollow core with the second heavy-duty core to enable simultaneous rotation in the printing or plate-imaging machine.

2. The supply spool of claim 1, wherein the first hollow core is made of a material that enables using the same disposal process for the first hollow core and for used printing plate material film.

3. The supply spool of claim 2, wherein the plate material film and the first hollow core are made of a material selected from the group consisting of plastic, polyester and Aluminum.

4. The supply spool of claim 1, wherein the second heavy-duty core is heavier than the hollow core.

5. The supply spool of claim 1, wherein the first hollow core comprises two symmetrical longitudinal slots and the second heavy-duty core comprises a longitudinal penetrating slot, and while the first hollow core and the second heavy-duty core are engaged, the two symmetrical longitudinal slots and the longitudinal penetrating slot form a merged penetrating slot.

6. The supply spool of claim 5, wherein after unwrapping the printing plate material film, the engaged first hollow core and second heavy-duty core is used as an uptake spool.

7. The supply spool of claim 6, further comprising a tab in a free end of the printing plate material film, and wherein the tab is adapted to be transferred through the merged penetrating slot of the uptake spool.

8. A method for loading the printing plate material supply spool of claim 1 in printing or plate imaging machines, the method comprising:

inserting the second heavy-duty core inside the first hollow core of the printing plate material supply spool forming an integrated core;

engaging the second heavy-duty core with the first hollow core using the coupling mechanism of the first hollow core; and placing the supply spool having the integrated core in a machine to enable simultaneous rotation of the first hollow core with the second heavy-duty core.

9. The method of claim 8, further comprising using a bare integrated core without the printing plate material film as an uptake spool for collecting used plate material film.

10. The method of claim 8, wherein placing the supply spool having the integrated core in the machine comprises inserting a first coupling member in one side of the integrated core and an engagement member in the other side of the integrated core, wherein the first coupling member and the engagement member are used to match a coupling mechanism and an engagement mechanism in the machine.

11. The method of claim 10, wherein the first coupling member is part of the second heavy-duty core.

12. The method of claim 11, wherein the first hollow core is made of a material selected from the group consisting of plastic, Aluminum and carton.

13. The method of claim 10, wherein the engagement member is part of the second heavy-duty core.

14. The method of claim 8, comprising disposing the first hollow core and the printing plate material using the same disposal process.

15. The method of claim 8, comprising transferring a tab located at a leading edge of the plate material film through a penetrating longitudinal slot, from one side of the second heavy-duty core to the other side of the second heavy-duty core.

16. The method of claim 15, wherein the tab passes through a central axis of the second heavy-duty core.

17. The method of claim 8, wherein the second heavy-duty core is heavier than the first hollow core.

18. The method of claim 8, wherein the second heavy-duty core comprises two parts, a left part and a right part, and wherein inserting the second heavy-duty core inside the first hollow core further comprises:

inserting the left part of the second heavy-duty core through a left facet of the first hollow core; and inserting the right part of the second heavy-duty core through a right facet of the first hollow core.

19. The method of claim 18, further comprising engaging the inserted left part of the second heavy-duty core with the inserted right part of the second heavy-duty core.

* * * * *